US011024931B2

(12) United States Patent
Tamiazzo et al.

(10) Patent No.: US 11,024,931 B2
(45) **Date of Patent: *Jun. 1, 2021**

(54) IN-LINE FILTER HAVING MUTUALLY COMPENSATING INDUCTIVE AND CAPACITIVE COUPLING

(71) Applicant: CommScope Italy S.r.l., Agrate Brianza (IT)

(72) Inventors: Stefano Tamiazzo, Milan (IT); Giuseppe Resnati, Seregno (IT)

(73) Assignee: CommScope Italy, S.R.L.

( * ) Notice: Subject to any disclaimer, the term of this patent is extended or adjusted under 35 U.S.C. 154(b) by 0 days.

This patent is subject to a terminal disclaimer.

(21) Appl. No.: 16/846,614

(22) Filed: Apr. 13, 2020

(65) Prior Publication Data

US 2020/0243939 A1 Jul. 30, 2020

Related U.S. Application Data

(63) Continuation of application No. 16/257,124, filed on Jan. 25, 2019, now Pat. No. 10,658,722, which is a (Continued)

(51) Int. Cl.
*H01P 1/205* (2006.01)

(52) U.S. Cl.
CPC ..... *H01P 1/2053* (2013.01); *H01P 1/205* (2013.01)

(58) Field of Classification Search
CPC ..... H01P 1/2053; H01P 1/205
(Continued)

(56) References Cited

U.S. PATENT DOCUMENTS 2,527,664 A 10/1950 Wheeler
5,812,036 A 9/1998 Estrada
(Continued)

FOREIGN PATENT DOCUMENTS

CN 1855614 11/2006
CN 102544650 7/2012
(Continued)

OTHER PUBLICATIONS

Extended European Search Report, corresponding to European Patent Application No. 20158254.1-1205, dated Jul. 6, 2020, 8 pages.

(Continued)

*Primary Examiner* — Stephen E. Jones
(74) *Attorney, Agent, or Firm* — Myers Bigel, P.A.

(57) ABSTRACT

An in-line resonator filter has a linear array of three or more conductors. A first pair of adjacent conductors has inductive main coupling and oppositely signed capacitive main coupling, while a second pair of non-adjacent conductors has inductive cross-coupling. The first and second pairs have one conductor in common. Between the second pair of non-adjacent conductors, there is no direct ohmic connection that provides the corresponding inductive cross-coupling. The oppositely signed capacitive main coupling compensates for at least a portion of the inductive main coupling between the first pair of adjacent conductors. The in-line resonator filter is able to provide one or more transmission zeros without requiring any discrete bypass connectors that provide direct ohmic connection between pairs of non-adjacent conductors. As such, the in-line resonator filters can be smaller, less complex, and less susceptible to damage.

20 Claims, 12 Drawing Sheets

Related U.S. Application Data continuation of application No. 15/529,775, filed as application No. PCT/EP2015/065916 on Jul. 10, 2015, now Pat. No. 10,236,550.

(60) Provisional application No. 62/091,696, filed on Dec. 15, 2014.

(58) Field of Classification Search
USPC ..... 333/203, 206, 202
See application file for complete search history.

(56) References Cited

U.S. PATENT DOCUMENTS

| | | | |
|---|---|---|---|
| 10,236,550 | B2 | 3/2019 | Tamiazzo et al. |
| 10,658,722 | B2 * | 5/2020 | Tamiazzo ..... H01P 1/2053 |
| 2010/0188171 | A1 | 7/2010 | Mohajer-Iravani et al. |
| 2011/0241801 | A1 | 10/2011 | Subedi |

FOREIGN PATENT DOCUMENTS

| | | |
|---|---|---|
| CN | 202797213 | 3/2013 |
| CN | 103138034 | 6/2013 |
| WO | 92/11664 | 7/1992 |
| WO | 2012/025946 A1 | 3/2012 |

OTHER PUBLICATIONS

Chinese Office Action Corresponding to Chinese Patent Application No. 201580062253.4 (Foreign Text, 9 Pages, English Translation Thereof, 9 Pages) (dated Dec. 27, 2018).

Communication Pursuant to Article 94(3) EPC, corresponding to European Patent Application No. 15 738 313.4-1205, dated Mar. 11, 2019, 6 pages.

International Search Report, International Application No. PCT/EP2015/065916, dated Oct. 27, 2015.

M. Makimoto, S. Yamashita, Microwave Resonators and Filters for Wireless Communication: Theory, Design and Application, Springer series in advanced microelectronics, vol. 4, 2001.

Macchiarella et al., "Generation of Canonical Forms for Multiport Filtering Networks", 2014 IEEE MTT-S International Microwave Symposium (IMS), Tampa, FL, Jun. 1-6, 2014, 3 pp.

Cameron, R. Mansour, C. M. Kudsia, Microwave Filters for Communication Systems: Fundamentals, Design and Applications, Ch. 3. Wiley, 2007.

S. Tamiazzo, G. Macchiarella, "An Analytical Technique for the Synthesis of Cascaded N-Tuplets Cross-Coupled Resonators Microwave Filters Using Matrix Rotations," IEEE Trans. Microwave Theory Tech., vol. MTT-53, n.5, May 2005, pp. 1693-1696.

Written Opinion of the International Searching Authority, International Application No. PCT/EF2015/065916, dated Oct. 27, 2015.

* cited by examiner

IN-LINE FILTER HAVING MUTUALLY COMPENSATING INDUCTIVE AND CAPACITIVE COUPLING

CROSS-REFERENCE TO RELATED APPLICATIONS

This application is a continuation under 35 U.S.C. § 120 of U.S. patent application Ser. No. 16/257,124, filed Jan. 25, 2019, which is a continuation under 35 U.S.C. § 120 of U.S. patent application Ser. No. 15/529,775, filed May 25, 2017, which is a 35 U.S.C. § 371 national stage application of PCT International Application Serial No. PCT/EP2015/065916, filed Jul. 10, 2015, which itself claims the benefit of the filing date of U.S. Provisional Application Ser. No. 62/091,696, filed on Dec. 15, 2014, the disclosure and content of each of which are incorporated herein by reference in their entireties.

BACKGROUND

Field of the Invention

The present invention relates to electronics and, more specifically but not exclusively, to resonator filters for radio frequency (RF) applications.

Description of the Related Art

This section introduces aspects that may help facilitate a better understanding of the invention. Accordingly, the statements of this section are to be read in this light and are not to be understood as admissions about what is prior art or what is not prior art.

One type of filter for RF applications is a resonator filter comprising an assemblage of coaxial resonators, where the overall transfer function of the resonator filter is a function of the responses of the individual resonators as well as the electromagnetic coupling between different pairs of resonators within the assemblage.

U.S. Pat. No. 5,812,036 ("the '036 patent"), the teachings of which are incorporated herein by reference, discloses a number of different resonator filters having different configurations and topologies of coaxial resonators.

FIG. 1 of this specification corresponds to FIG. 3 of the '036 patent, which depicts a top sectional view of a six-stage resonator filter 200 having a (2×3) array of coaxial resonators R1-R6 between input terminal 204 and output terminal 206. The resonator filter 200 has five coupling holes H1-H5 between the five sequential pairs of resonators R1-R6 that enable main coupling between the sequential pairs. In addition, the resonator filter 200 has a first bypass coupling aperture $A_{C1}$ that enables cross-coupling between the non-sequential pair of resonators R2 and R5. The resonator filter 200 also has a second bypass coupling aperture $A_{C2}$ that enables cross-coupling between the non-sequential pair of resonators R1 and R6. The main couplings between the five sequential pairs of resonators and the cross-couplings between the two non-sequential pairs of resonators contribute to the overall transfer function of the resonator filter 200.

FIGS. 2A and 2B of this specification correspond respectively to FIGS. 1A and 1B of the '036 patent, which depict overhead and side sectional views of a four-stage in-line resonator filter 1 having a linear array of four coaxial resonators 5-8 between input terminal 30 and output terminal 40. The resonator filter 1 has three coupling holes A1-A3 between the three sequential pairs of resonators 5-8 that enable main coupling between the sequential pairs. To achieve cross-coupling between the non-sequential pair of resonators 5 and 8, the resonator filter 1 has a discrete, external, bypass connector $C_C$ represented in phantom in the figures that provides a direct ohmic connection between resonators 5 and 8. The term "direct ohmic connection" means that the external bypass connector physically interconnects resonator 5 to resonator 8 without physically contacting any of the intervening resonators (i.e., resonators 6 and 7). As explained in the '036 patent, this type of external bypass connector increases filter size and complexity, and renders the resonator filter 1 susceptible to damage.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 3:
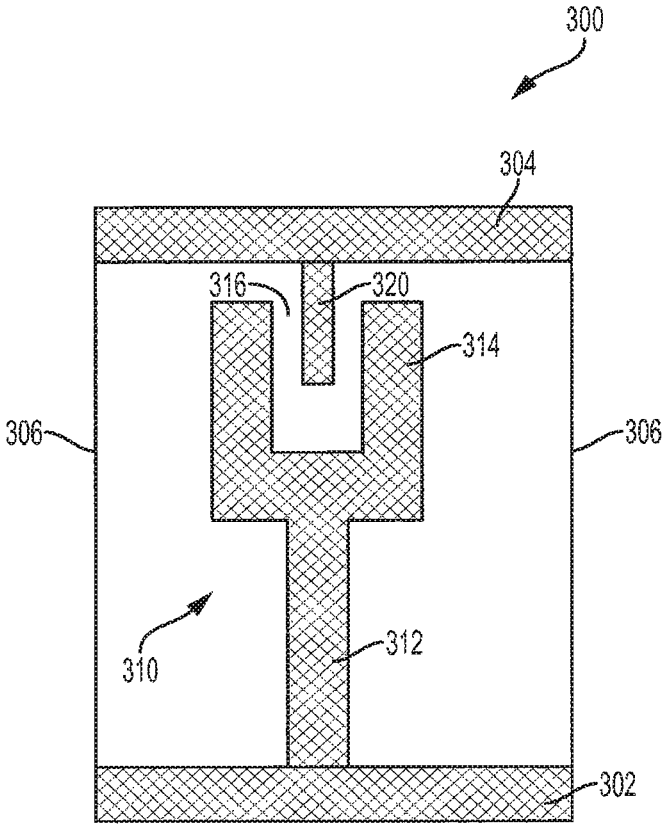
FIG. 3 is a side sectional view of a resonator filter.

FIG. 3 is a side sectional view of a resonator filter 300. Filter 300 has a bottom ground plane 302, a top ground plane 304, and a lateral ground plane 306. Although not specified in FIG. 3, filter 300 typically has a cylindrical or rectilinear 3D shape.

The interior structure of filter 300 includes a single, inner conductor 310 consisting of (i) a high-impedance (cylindrical or rectilinear) base 312 that is shorted to the bottom ground plane 302 and (ii) a low-impedance, cup-shaped head 314 that does not contact the top ground plane 304. Depending on the amount of self and mutual capacitance needed, instead of being cup-shaped, head 314 may be shaped like a tuning fork. In addition, filter 300 has a cylindrical tuning element 320 that extends from the top ground plane 304 into the inner volume 316 defined by the cup-shaped head 314. The shapes, dimensions, locations, and compositions of the various elements of the inner conductor 310 define the inherent transfer function of the resonator filter 300.

In certain embodiments, the position of the tuning element 320, which might or might not be shorted to the top ground plane 304, can be adjusted (e.g., by rotating the tuning element when the tuning element is a threaded screw engaging a tapped screw hole in the top ground plane 304) to change the degree to which the tuning element vertically extends within the inner volume 316 in order to alter the coupling within the resonator and thereby tune the overall transfer function of the single-resonator filter 300 to be different from the filter's inherent transfer function.

Figure 4:
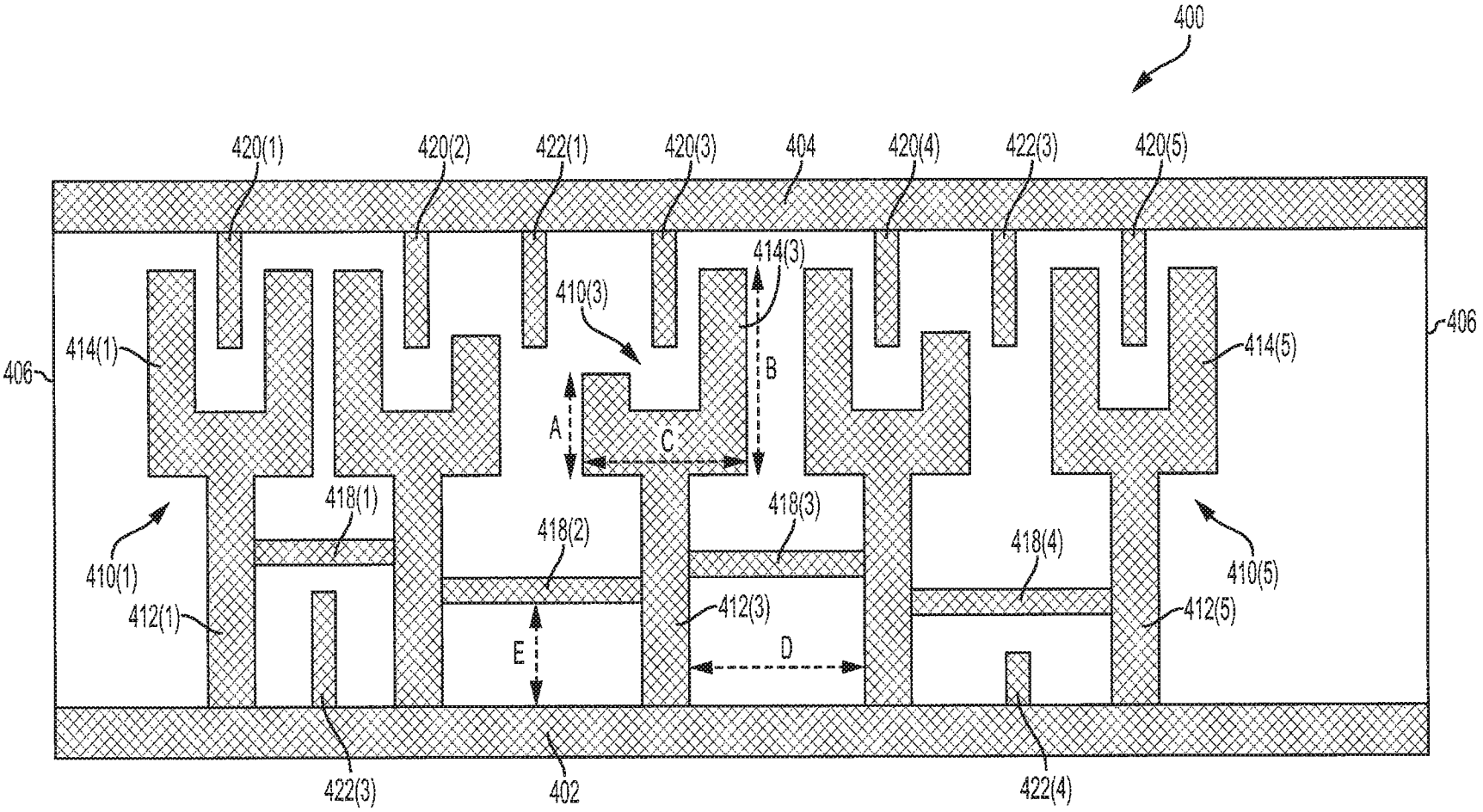
FIG. 4 is a side sectional view of an in-line resonator filter according to one embodiment of the invention.

FIG. 4 is a side sectional view of an in-line resonator filter 400 according to one embodiment of the invention. Like resonator filter 300 of FIG. 3, resonator filter 400 has a bottom ground plane 402, a top ground plane 404, and a lateral ground plane 406. Although not specified in FIG. 4, filter 400 would typically have a rectilinear 3D shape.

Unlike resonator filter 300 of FIG. 3 which has only a single inner conductor 310, in-line resonator filter 400 has five inner conductors 410(1)-410(5), each of which having (i) a high-impedance base 412(*i*) that is shorted to the bottom ground plane 402 and (ii) a low-impedance, shaped head 414(*i*) that does not contact the top ground plane 404. In some implementations, the inner conductors 410 are designed to function as stepped impedance resonators (SIRs).

Figure 1:
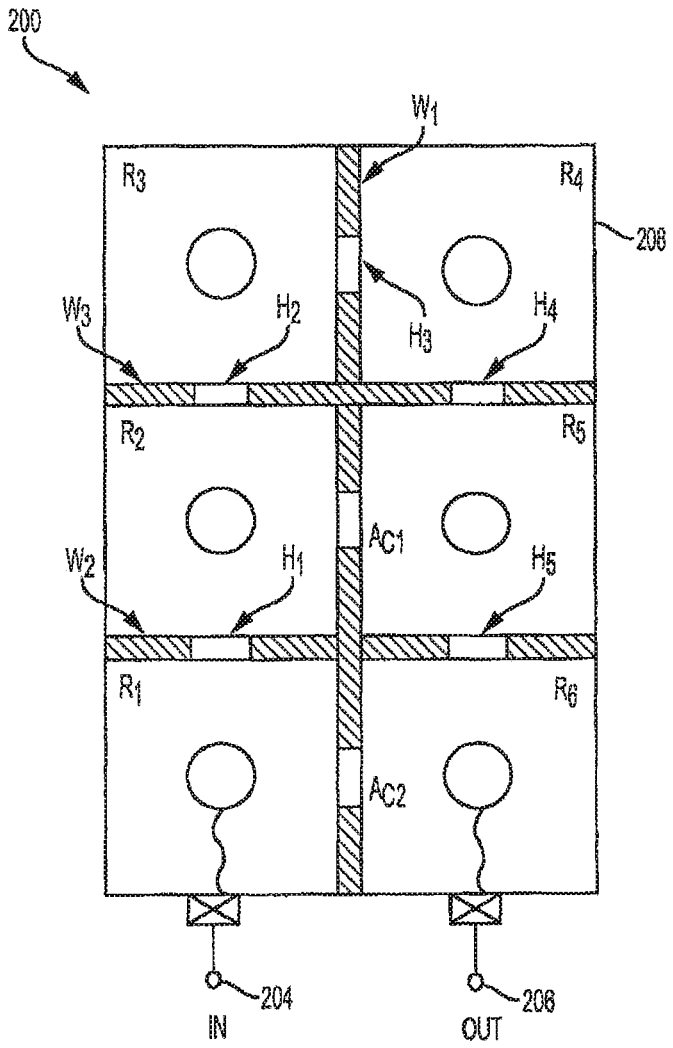
FIG. 1 PRIOR ART
FIG. 1, which corresponds to FIG. 3 of the '036 patent, depicts a top sectional view of a six-stage resonator filter having a 2×3 array of coaxial resonators.
Figure 2A:
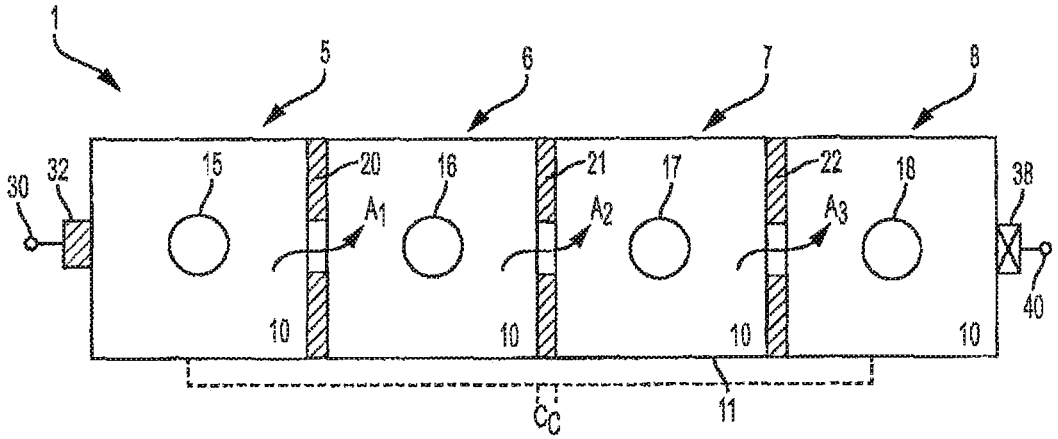
FIG. 2A PRIOR ART
FIGS. 2A and 2B, which correspond respectively to FIGS. 1A and 1B of the '036 patent, depict overhead and side sectional views of a four-stage in-line resonator filter having a linear array of four coaxial resonators.
Figure 2B:
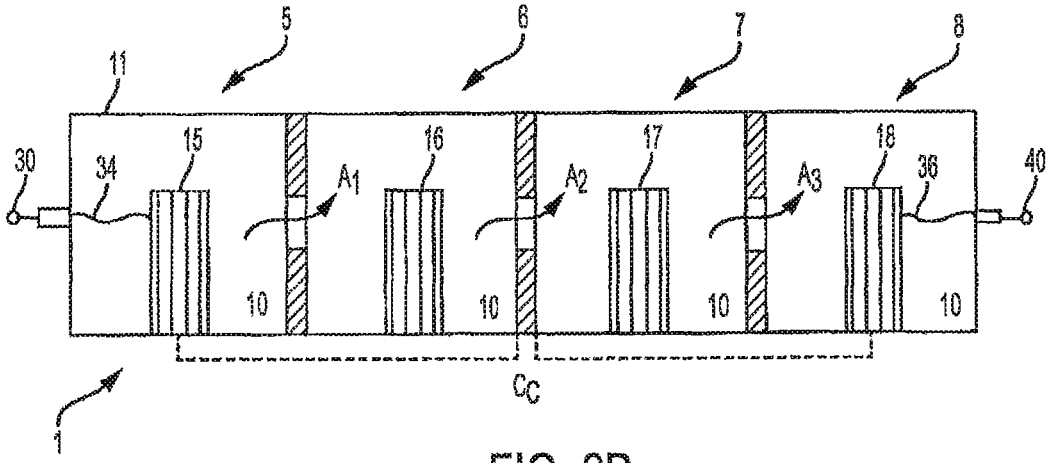
FIG. 2B PRIOR ART

Like prior-art in-line resonator filter 1 of FIGS. 2A-2B, the five inner conductors 410(1)-410(5) of in-line resonator filter 400 are linearly arranged to form a one-dimensional array of conductors. Note, however, that the inner conductors 410 can, but do not have to be perfectly aligned. One or more of the inner conductors 410 may be displaced towards the front or back of the resonator filter 400 (i.e., into or out of the page). Note further that, unlike prior-art in-line resonator filter 1, there are no intervening walls between adjacent inner conductors 410 in the resonator filter 400. As explained further below, this enables more-substantial cross-coupling to occur between pairs of non-adjacent inner conductors 410.

Like resonator filter 300 of FIG. 3, each inner conductor 410(*i*) in resonator filter 400 has a corresponding tuning element 420(*i*). Resonator filter 400 also has four additional tuning elements 422(1)-422(4) located between corresponding adjacent inner conductors 410, where additional tuning elements 422(1) and 422(2) extend from the top ground plane 404, while additional tuning elements 422(3) and 422(4) extend from the bottom ground plane 402.

As shown in FIG. 4, resonator filter 400 also has four conductive connectors 418(1)-418(4), each providing a physical (i.e., ohmic) connection between a different one of the four pairs of adjacent inner conductors 410.

Note that some of the heads 414 of the inner conductors 410 of resonator filter 400 have different shapes and that the inter-conductor spacing between the inner conductors 410 varies from adjacent pair to adjacent pair. In FIG. 4, heads 414(1) and 414(5) may be either cup-shaped or fork-shaped, while heads 414(2)-414(4) are necessarily fork-shaped. In addition, the height of the inter-conductor connectors 418 also varies from adjacent pair to adjacent pair. Note further that the resonator filter 400 is asymmetric along its lateral dimension in that a 180-degree rotation about, for example, the vertical axis of base 412(3) of inner conductor 410(3) results in a view that is different from the view of the resonator filter 400 shown in FIG. 4. All of these different and varying features of the resonator filter 400 contribute to its overall filter transfer function. The features can therefore by specifically designed to achieve a desired filter transfer function.

In general, based on the particular design of resonator filter 400, there is both inductive and capacitive main coupling between each of the four pairs of adjacent inner conductors 410, where, for each pair, the sign of the capacitive main coupling is the opposite of the sign of the inductive main coupling, such that the capacitive and inductive main couplings compensate for one another to at least some degree. In addition, resonator filter 400 has been designed such that there is non-negligible (e.g., inductive) cross-coupling between certain pairs of non-adjacent inner conductors 410, where that non-negligible cross-coupling is achieved without employing discrete bypass connectors that ohmically connect non-adjacent inner conductors 410, whether those bypass connectors are internal or external to the resonator filter 400. For example, there may be non-negligible cross-coupling between inner conductor 410(1) and inner conductor 410(3). In addition, there may be smaller, but still non-negligible cross-coupling between inner conductors 410(1) and 410(4) or even between inner conductors 410(1) and 410(5). In general, the greater the separation distance between two inner conductors, the smaller the coupling strength.

Two basic coupling mechanisms take place, both contributing to the amount of coupling between adjacent and non-adjacent inner conductors: capacitive coupling and inductive coupling.

Capacitive coupling can be controlled by adjusting the length and/or the impedance of the capacitive head 414 of each inner conductor 410 (e.g., by independently adjusting the dimensions A, B, and C of inner conductor 410(3)). This kind of interaction will contribute with a negative amount of capacitive coupling for adjacent pairs of inner conductors 410 and a positive amount of capacitive coupling for non-adjacent pairs of inner conductors.

Inductive coupling can be controlled by adjusting the lengths (D in FIG. 4) and/or the heights (E in FIG. 4) of the inter-conductor connections 418 connecting the different pairs of adjacent inner conductors, where the distance and height might vary from connection to connection. This kind of interaction will contribute with a positive amount of inductive coupling for both adjacent and non-adjacent pairs of inner conductors 410.

The capacitive and inductive contributions of the main couplings (i.e., between adjacent conductors) and the cross-couplings (i.e., between non-adjacent conductors) can be designed to meet prescribed coupling values, at least within a certain range of prescribed coupling values. The sign of the cross-couplings is always positive for the structure considered, while the sign of the main couplings can be conveniently set according to the specific blend of capacitive and inductive couplings. It is then possible to realize networks of coupled resonators and mixed signed couplings.

Depending on the number and location of the input/output (I/O) ports coupled to suitably selected inner conductors, different types of in-line resonator filters can be implemented. In-line resonator filters of the invention, such as in-line resonator filter 400 of FIG. 4, can be represented by Halma topologies that indicate the non-negligible main and cross-couplings between adjacent and non-adjacent conductors.

Figure 5:
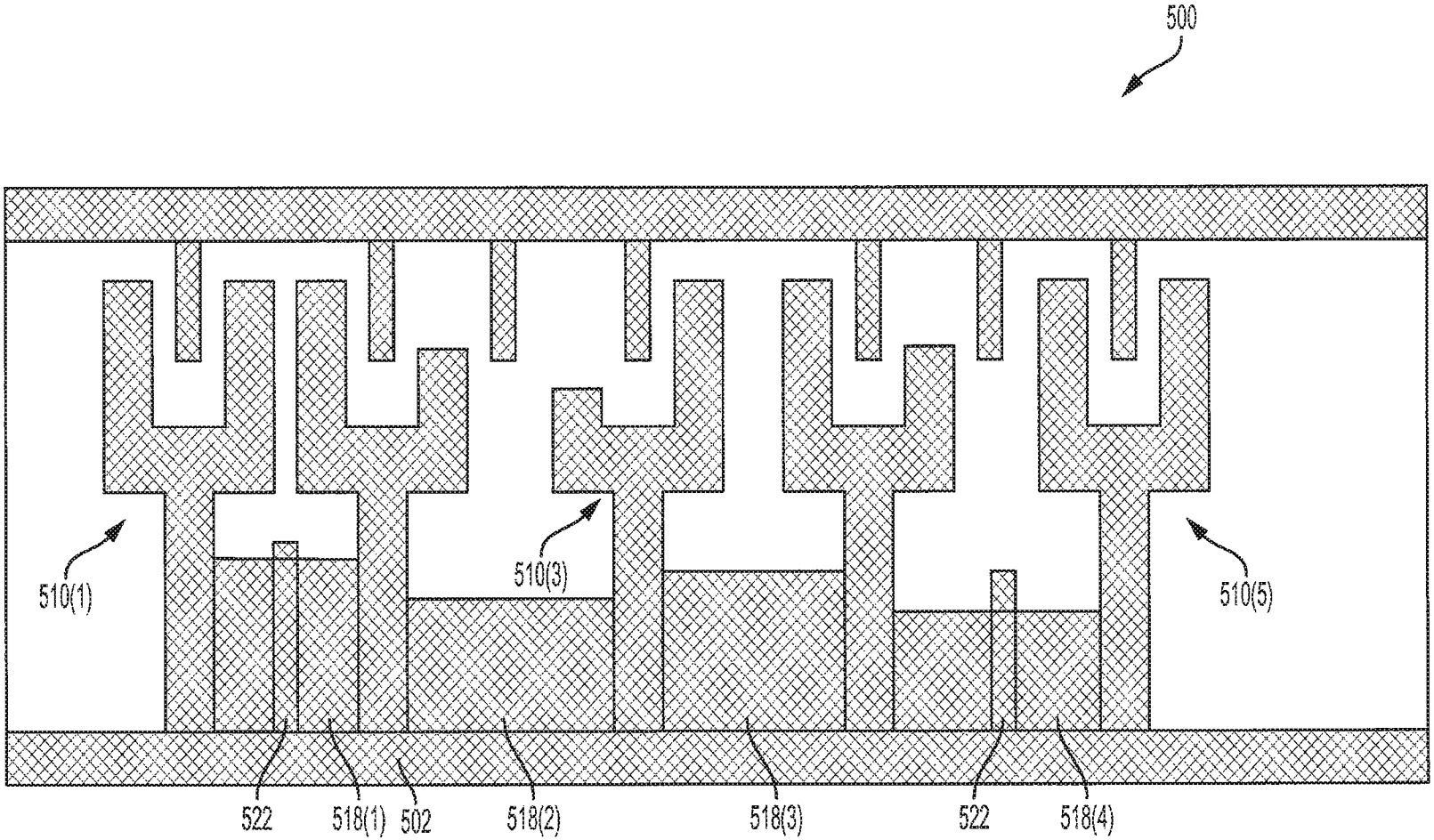
FIG. 5 is a side sectional view of an in-line resonator filter according to another embodiment of the invention.

FIG. 5 is a side sectional view of an in-line resonator filter 500 according to another embodiment of the invention. In-line resonator filter 500 is similar to in-line resonator filter 400 of FIG. 4, with analogous elements identified using analogous labels. Note that, in resonator filter 500, the four conductive connectors 518(1)-518(4) that provide physical connections between different pairs of adjacent inner conductors 510 are wall-shaped elements that extend downward to the bottom ground plane 502 with the tuning elements 522 emerging over those connectors.

Figure 6:
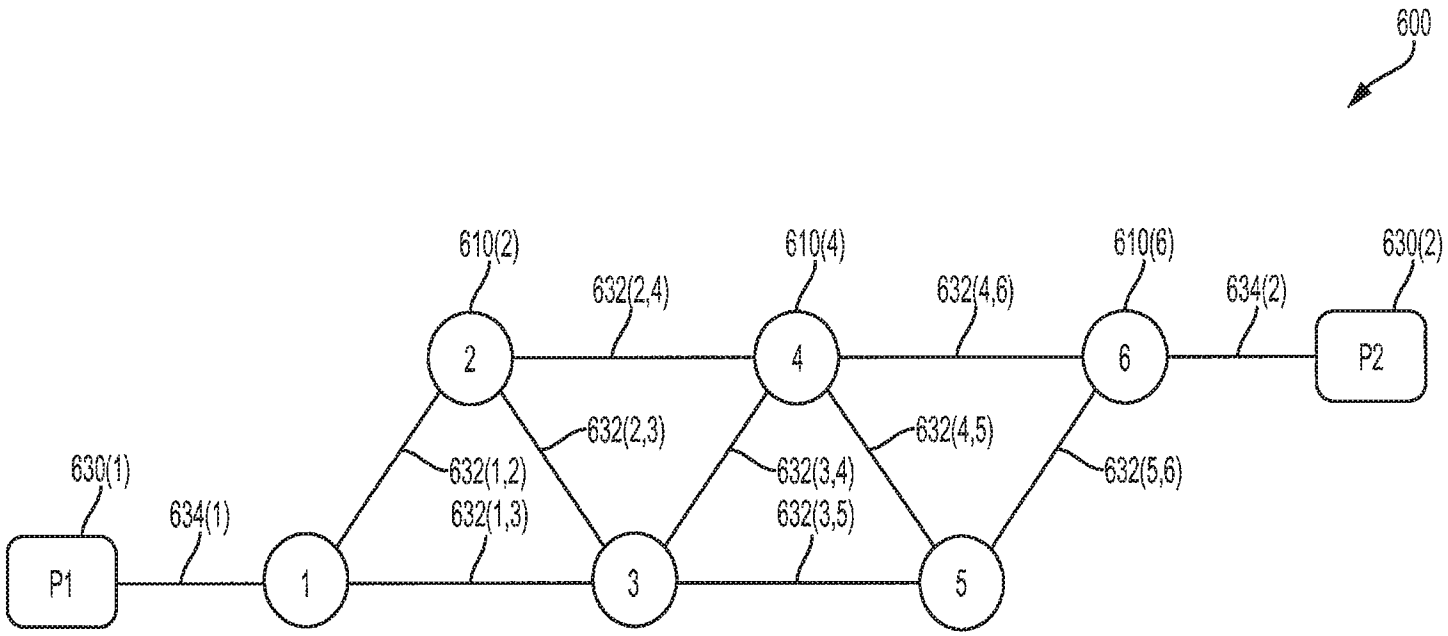
FIGS. 6-10 depict the Halma topologies of six-stage, two-port, in-line resonator filters having six inner conductors and two input/output (I/O) ports according to different embodiments of the invention.

FIG. 6 depicts the Halma topology of a six-stage, two-port, in-line resonator filter 600 having six inner conductors 610(1)-610(6) and two input/output (I/O) ports 630(1) and 630(2) according to one embodiment of the invention. Note that, although the Halma topology is depicted as a two-dimensional distribution of inner conductors, that is only to indicate the various couplings within the resonator filter 600. The physical implementation of the resonator filter 600 involves the six inner conductors 610(1)-610(6) arranged linearly.

The inter-conductor links in FIG. 6 represent the non-negligible couplings within resonator filter 600. In particular, link 632(1,2) represents the main coupling between adjacent conductors 610(1) and 610(2), while link 632(2,3) represents the main coupling between adjacent conductors 610(2) and 610(3), and analogously for links 632(3,4), 632(4,5), and 632(5,6). On the other hand, link 632(1,3) represents the cross-coupling between non-adjacent conductors 610(1) and 610(3), link 632(2,4) represents the cross-coupling between non-adjacent conductors 610(2) and 610(4), and analogously for links 632(3,5) and 632(4,6).

As depicted in FIG. 6, I/O port 630(1) is connected to inner conductor 610(1) via I/O link 634(1), while I/O port 630(2) is connected to inner conductor 610(6) via I/O link 634(2). Depending on the particular implementation, I/O links 634(1) and 634(2) may be ohmic or non-ohmic connections between the corresponding I/O ports 630 and inner conductors 610.

Although in-line resonator filter 600 has six inner conductors, in general, in-line resonator filters of this type can be implemented with a linear array having any number N>2 of inner conductors with two I/O ports respectively connected to the first and last inner conductors in the linear array. When the number N of inner conductors is odd, the in-line resonator filter can be designed to provide up to (N−1)/2 transmission zeros. When the number N of inner conductors is even, the in-line resonator filter can be designed to provide up to N/2−1 transmission zeros.

As an advantage, asymmetric responses exhibiting transmission zeros can be implemented using a linear arrangement of N inner conductors without the need of discrete bypass connectors that provide direct ohmic connection to pairs of non-adjacent inner conductors. At least in principle, there is no restriction on the location of the transmission zeros, which may be located above as well as below the pass-band.

Figure 7:
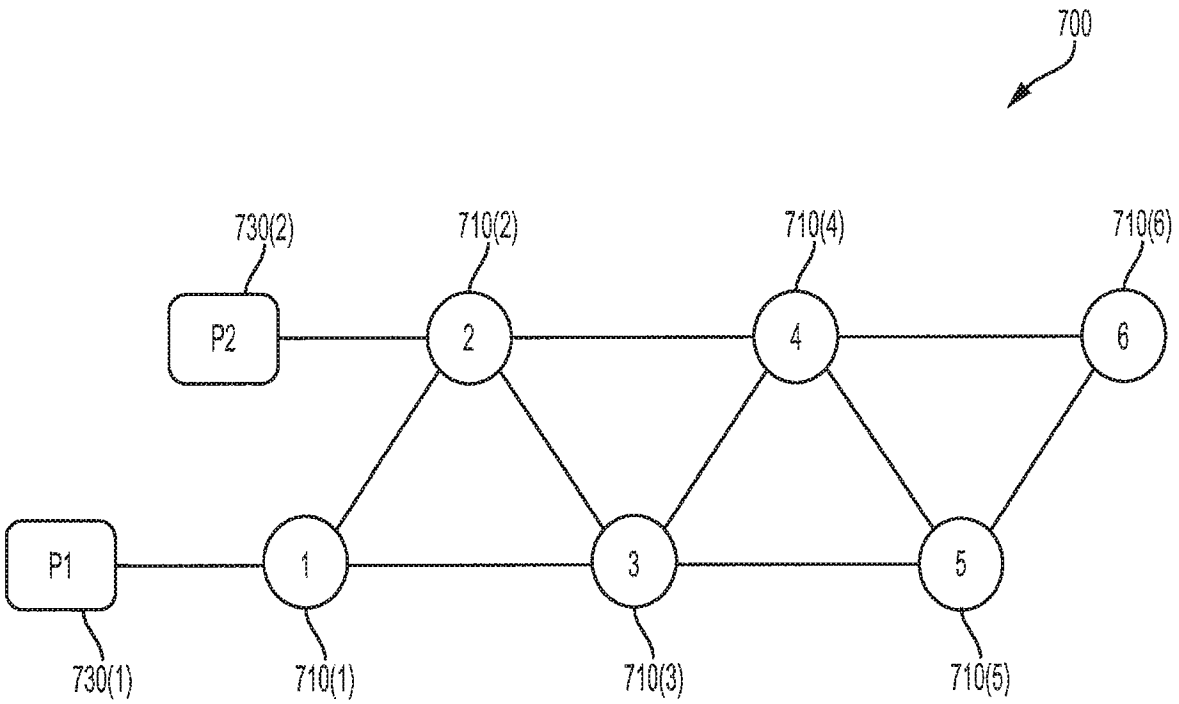

FIG. 7 depicts the Halma topology of a six-stage, two-port, folded, in-line resonator filter 700 having six inner conductors 710(1)-710(6) and two I/O ports 730(1) and 730(2) according to another embodiment of the invention. Folded, in-line resonator filter 700 is similar to in-line resonator filter 600 of FIG. 6 with analogous main and cross-couplings between adjacent and non-adjacent conductors 710, except that, in resonator filter 700, the second I/O port 730(2) is connected to the second inner conductor 710(2) instead of the last inner conductor 710(6). With its quasi-canonical folded topology, in-line resonator filter 700 can provide up to four transmission zeros. In general, an N-stage, folded, in-line resonator filter of the invention can provide up to N−2 transmission zeros. Again there is, at least in principle, no limit on the location of such transmission zeros.

Figure 8:
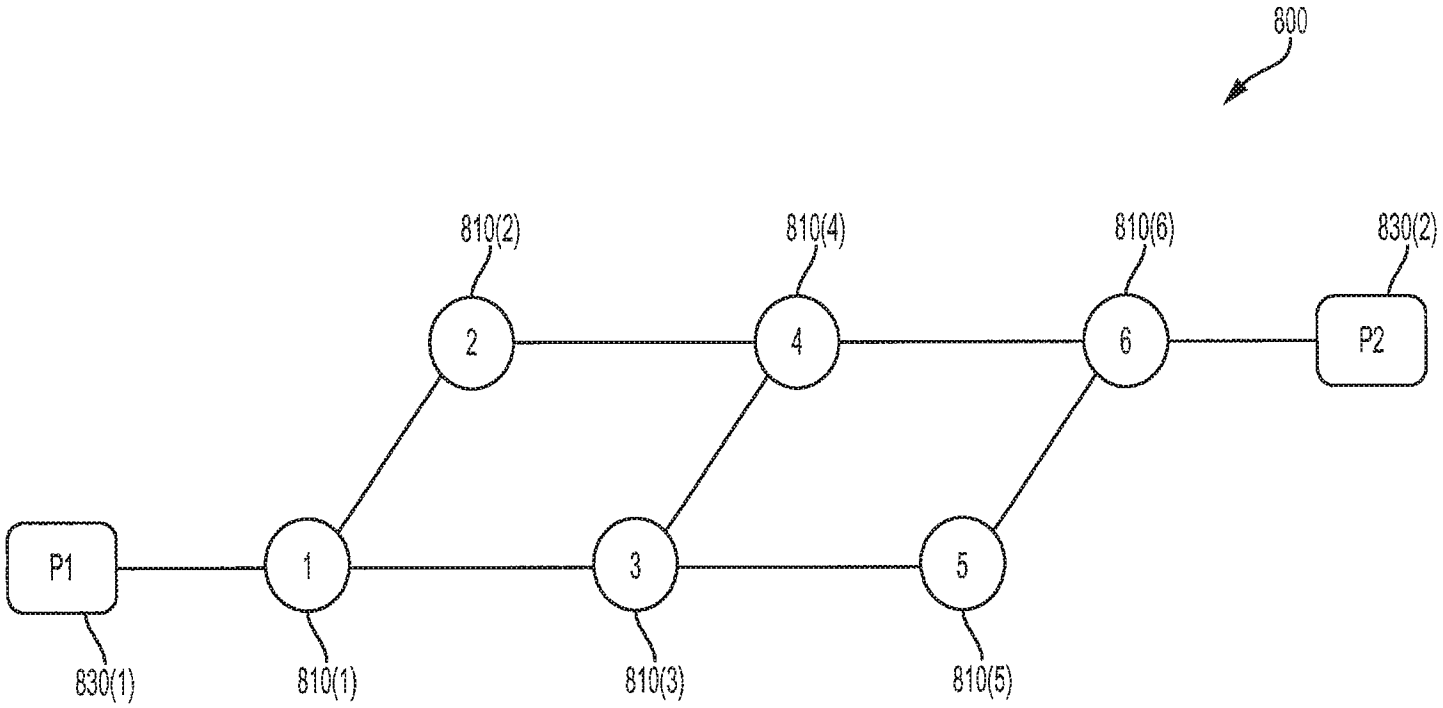

FIG. 8 depicts the Halma topology of a six-stage, two-port, extended-box, in-line resonator filter 800 having six inner conductors 810(1)-810(6) and two I/O ports 830(1) and 830(2) according to another embodiment of the invention. Extended-box, in-line resonator filter 800 is similar to in-line resonator filter 600 of FIG. 6, except that, in resonator filter 800, the main couplings between adjacent conductors 810(2) and 810(3) and between adjacent conductors 810(4) and 810(5) are negligible or even non-existent. Each negligible or non-existent main coupling may be achieved by having the negative capacitive coupling between the two corresponding conductors negate the positive inductive coupling between those same two conductors.

In general, for an N-stage resonator filter, where N is even, when (i) the two I/O ports are coupled to the first and last inner conductors and (ii) the main couplings from conductor 2 k to conductor 2 k+1 (k=1, . . . , N/2−1) are designed to be as small as possible (ideally zero), an extended-box topology of degree N results with the ability to accommodate up to N/2−1 transmission zeros. Again there is, at least in principle, no limit on the location of such transmission zeros.

Figure 9:
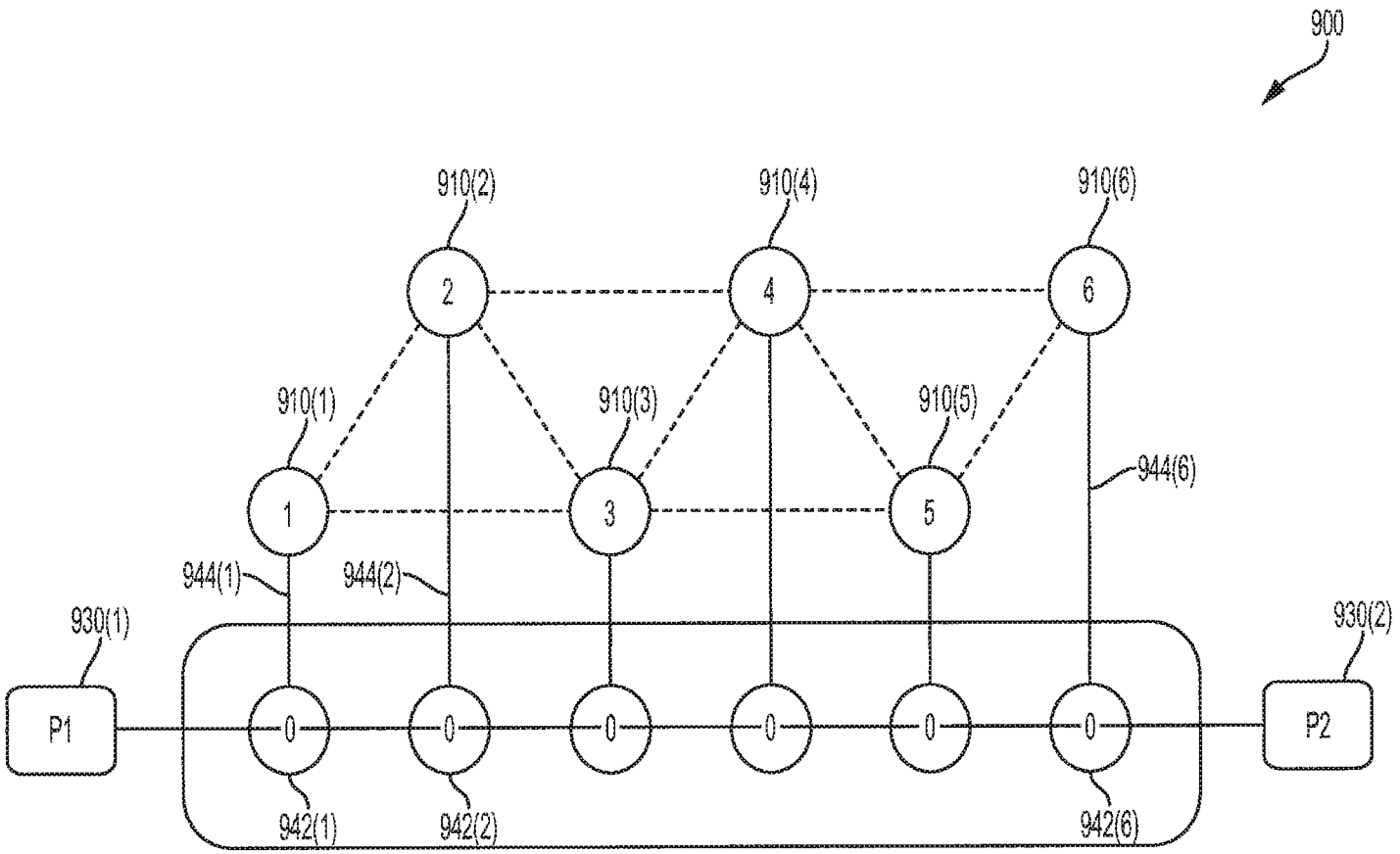

FIG. 9 depicts the Halma topology of a six-stage, two-port, extracted-poles, in-line resonator filter 900 having six inner conductors 910(1)-910(6) and two I/O ports 930(1) and 930(2) according to another embodiment of the invention. Extracted-poles, in-line resonator filter 900 is similar to in-line resonator filter 600 of FIG. 6, except that, in resonator filter 900, (i) all of the inter-conductor couplings are negligible or zero and (ii) each inner conductor **910(*i*) is connected to a corresponding non-resonating node 942(*i*) of an external network 940 via a corresponding (ohmic) connection 944(*i*), where the two I/O ports 930(1) and 930(2) are connected to the first and last non-resonating nodes 942(1) and 942(6) of the external network 940. In that case, an extracted pole topology of degree N=6 results with the ability to accommodate up to N=6 transmission zeros. The external coupling network 940 needs to realize a manifold-like connection between the I/O ports 930 and the resonating nodes (i.e., the inner conductors 910) and might be implemented on a printed circuit board in microstrip technology, for example. The non-resonating nodes 942** might then be implemented as stubs of suitable length.

Figure 10:
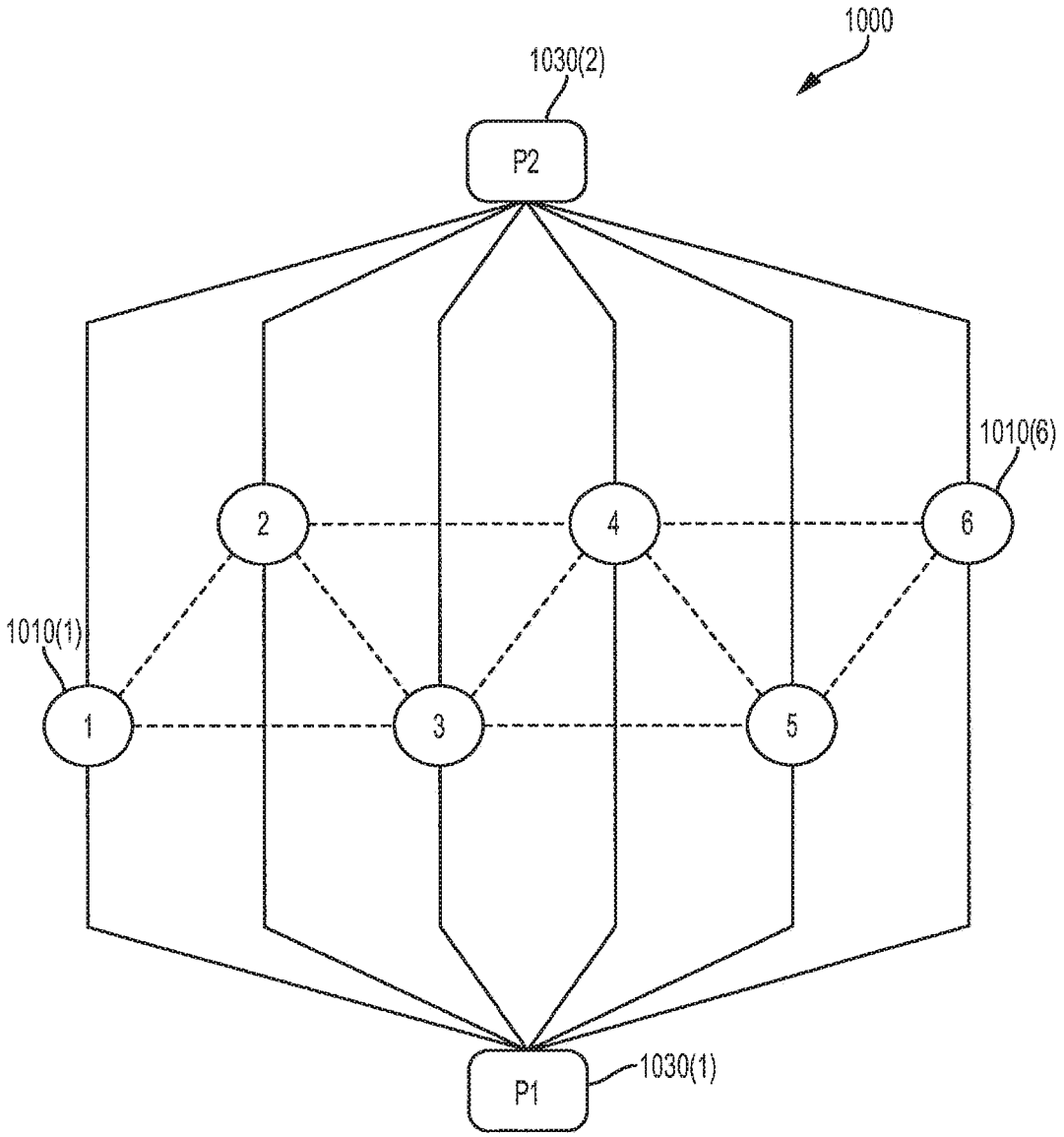

FIG. 10 depicts the Halma topology of a six-stage, two-port, transversal, in-line resonator filter 1000 having six inner conductors 1010(1)-1010(6) and two I/O ports 1030(1)

and 1030(2) according to another embodiment of the invention. Transversal, in-line resonator filter 1000 is similar to in-line resonator filter 900 of FIG. 9 with negligible or zero inter-conductor coupling, except that, in resonator filter 1000, each inner conductor 1010(*i*) is connected to both I/O ports 1030(1) and 1030(2). In that case, a transversal topology of degree N=6 results with the ability to accommodate up to N−1=5 transmission zeros. Transversal, in-line resonator filter 1000 has two external coupling networks, where each external coupling network realizes a star-like connection between the corresponding I/O port 1030(*i*) and the inner conductors 1010, where both external coupling networks might be implemented on a single printed circuit board in microstrip technology, for example.

Figure 11:
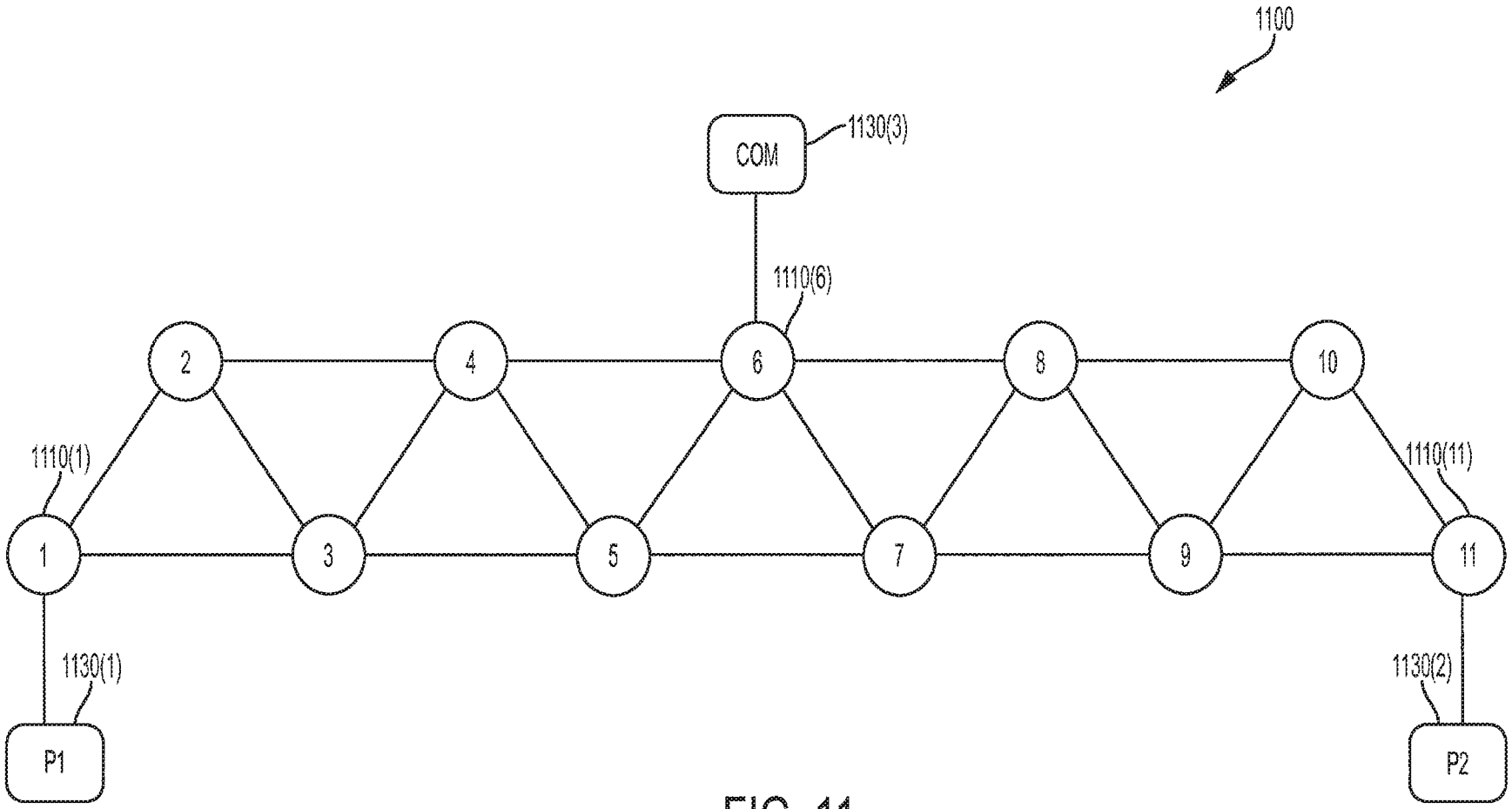
FIG. 11 depicts the Halma topology of an 11-stage, three-port, diplexer, in-line resonator filter having eleven inner conductors and three I/O ports according to another embodiment of the invention.

FIG. 11 depicts the Halma topology of an 11-stage, three-port, diplexer, in-line resonator filter 1100 having eleven inner conductors 1110(1)-1110(11) and three I/O ports 1130(1), 1130(2), 1130(3) according to another embodiment of the invention. Diplexer, in-line resonator filter 1100 is analogous to in-line resonator filter 600 of FIG. 6, except that, in resonator filter 1100, an intermediate inner conductor 1110(6) is connected to the intermediate, third I/O port 1130(3).

The 11-stage, diplexer, in-line resonator filter 1100 has a first in-line path of degree 6−1=5 from the first I/O port 1130(1) to the intermediate I/O port 1130(3) and a second in-line path of degree 11−6=5 from the intermediate I/O port 1130(3) to the second I/O port 1130(2). In general, an N-stage, three-port, diplexer, in-line resonator filter of the invention having the Kth inner conductor, 1<K<N, connected to the intermediate I/O port will have a first in-line path of degree K−1 from the first I/O port to the intermediate I/O port and a second in-line path of degree N-K from the intermediate I/O port to the second I/O port. The number of available transmission zeros for each path is computed in the same way as in the case of in-line filter 600 of FIG. 6. Note that, for N odd, K can, but does not have to, equal (N+1)/2. In other words, the degrees of the two in-line paths can be the same or different.

Figure 12:
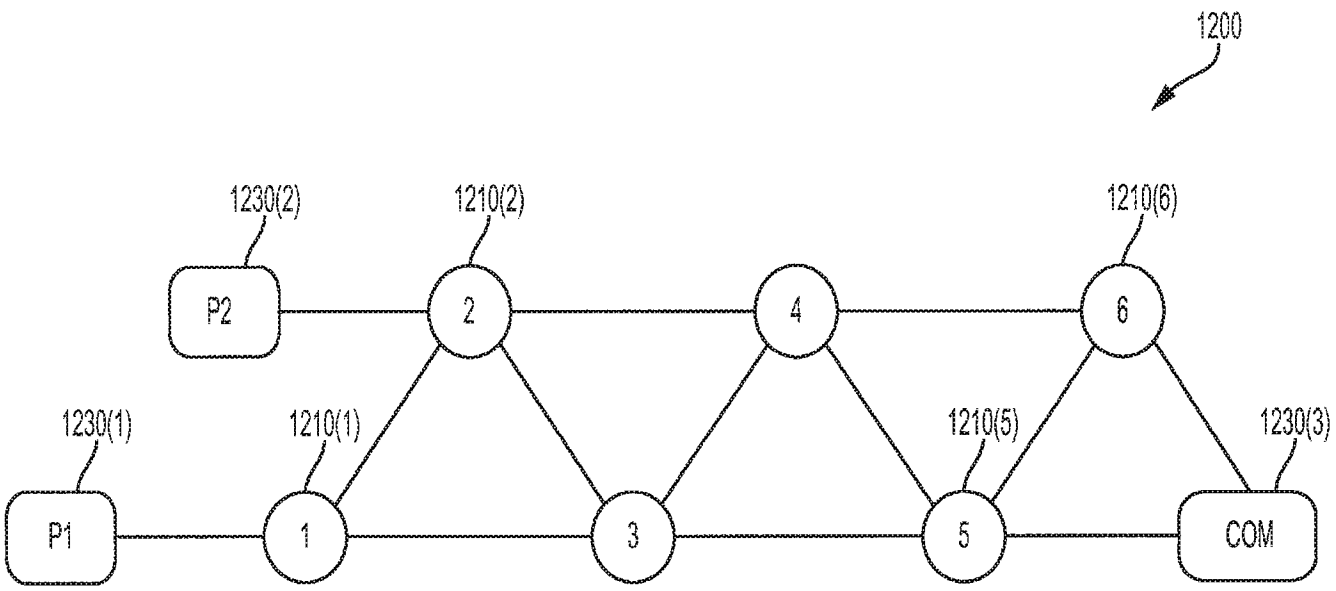
FIG. 12 depicts the Halma topology of a 6-stage, three-port, arrow-diplexer, in-line resonator filter having six inner conductors and three I/O ports according to another embodiment of the invention.

FIG. 12 depicts the Halma topology of a 6-stage, three-port, arrow-diplexer, in-line resonator filter 1200 having six inner conductors 1210(1)-1210(11) and three I/O ports 1230(1), 1230(2), 1230(3) according to another embodiment of the invention. Arrow-diplexer, in-line resonator filter 1200 is similar to folded, in-line resonator filter 600 of FIG. 6, except that, in resonator filter 1200, conductors 1210(5) and 1210(6) are both connected to the I/O port 1230(3). Note that, in alternative embodiments, more than two inner conductors 1210 can be connected to the I/O port 1230(3), which will affect the number of available transmission zeros.

Resonator filters of the present invention may include air-filled cavity resonators, such as resonators having all-metal cavities, or dielectric-loaded resonators, such as TEM dielectric resonators.

Although the invention has been described in terms of resonator filters having an adjustable tuning element for each inner conductor and additional tuning elements located between adjacent conductors and extending from either the top or bottom ground plane, the invention is not so limited. In general, resonator filters of the present invention may have zero, one, or more tuning elements, where each tuning element is independently adjustable or fixed and extends from the top, bottom, and lateral ground plane.

Although the invention has been described in terms of resonator filters having inter-conductor connectors between each adjacent pair of inner conductors, the invention is not so limited. In general, one or more or all of the inter-conductor connectors can be omitted.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A resonator filter, comprising:

a top ground plane;

a bottom ground plane;

a first conductor, a second conductor and a third conductor, where the first conductor is adjacent the second conductor so that the first and second conductors together comprise a first pair of conductors having inductive main coupling and oppositely signed capacitive main coupling, and the third conductor is adjacent the second conductor so that the first and third conductors together comprise a second pair of non-adjacent conductors that have inductive cross-coupling, where each of the first through third conductors comprises a high-impedance base that is shorted to the bottom ground plane and a low-impedance distal end; and a first conducting connector that connects the base of the first conductor to the base of the second conductor; and a second conducting connector that connects the base of the second conductor to the base of the third conductor.

2. The resonator filter of claim 1, wherein the first through third conductors each comprise a coaxial resonator.

3. The resonator filter of claim 1, wherein there is no direct ohmic connection that provides the inductive cross-coupling between the first and third conductors.

4. The resonator filter of claim 1, wherein a first length of the first conducting connector above the bottom ground plane is different than a second length of the second conducting connector above the bottom ground plane.

5. The resonator filter of claim 1, wherein a first height of the first conducting connector above the bottom ground plane is different than a second height of the second conducting connector above the bottom ground plane.

6. The resonator filter of claim 5, wherein a first length of the first conducting connector above the bottom ground plane is different than a second length of the second conducting connector above the bottom ground plane.

7. The resonator filter of claim 1, wherein the first through third conductors are linearly arranged to form a one-dimensional array of conductors.

8. The resonator filter of claim 7, wherein the first through third conductors are not perfectly aligned.

9. The resonator filter of claim 1, further comprising a first adjustable tuning element that extends upwardly from the bottom ground plane.

10. The resonator filter of claim 9, further comprising a second adjustable tuning element that extends into the low-impedance distal end of one of the first through third conductors.

11. The resonator filter of claim 9, further comprising a third adjustable tuning element that extends downwardly from the top ground plane between two adjacent ones of the first through third conductors.

12. The resonator filter of claim 9, wherein the first through third conductors are three of a plurality of conductors.

13. The resonator filter of claim 12, wherein the first adjustable tuning element is positioned between two of the plurality of conductors.

14. The resonator filter of claim 12, wherein the distal end of at least some of the plurality of conductors comprises a shaped head, and wherein the shaped heads of two or more of the plurality of conductors are different.

15. The resonator filter of claim 12, wherein distances are different between different pairs of adjacent conductors of the plurality of conductors.

16. A resonator filter, comprising:

a top ground plane;

a bottom ground plane;

a first resonator that includes a first high-impedance base that is shorted to the bottom ground plane;

a second resonator that is adjacent the first resonator, the second resonator including a second high-impedance base that is shorted to the bottom ground plane;

a third resonator that is adjacent the second resonator, the third resonator including a third high-impedance base that is shorted to the bottom ground plane, where the second resonator is between the first and third resonators;

a first conducting connector that directly connects the first high-impedance base to the second high-impedance base; and a second conducting connector that connects the second high-impedance base to the third high-impedance base, wherein a first height of the first conducting connector above the bottom ground plane is different than a second height of the second conducting connector above the bottom ground plane.

17. The resonator filter of claim 16, wherein a first length of the first conducting connector above the bottom ground plane is different than a second length of the second conducting connector above the bottom ground plane; and where each of the first through third resonators comprises and a low-impedance distal end that does not contact the top ground plane of the resonator filter.

18. The resonator filter of claim 16, further comprising a first adjustable tuning element that extends upwardly from the bottom ground plane.

19. The resonator filter of claim 16, wherein the first through third conductors are not perfectly aligned.

20. The resonator filter of claim 16, wherein the distal end of at least two of the first through third resonators comprise respective shaped heads that have different shapes.

* * * * *